US006090519A

United States Patent [19]

Baklarz

[11] Patent Number: 6,090,519

[45] Date of Patent: Jul. 18, 2000

[54] PROCESS FOR OBTAINING PERMANENT REPRESENTATIONS OF FULL-TONE, FULL-COLOR PHOTOGRAPHS ON A BASE

[75] Inventor: Waldemar Baklarz, 21-36 47th St., Astoria, N.Y. 11105

[73] Assignee: Waldemar Baklarz, Astoria, N.Y.

[21] Appl. No.: 07/987,669

[22] Filed: Dec. 9, 1992

Related U.S. Application Data

[63] Continuation-in-part of application No. 07/844,508, Mar. 2, 1992, abandoned.

[51] Int. Cl.[7] ..... G03C 11/00

[52] U.S. Cl. ..... 430/198; 430/256; 430/291; 430/330; 430/952

[58] Field of Search ..... 430/198, 256, 430/291, 292, 293, 357, 952, 330

[56] References Cited

U.S. PATENT DOCUMENTS

| | | | |
|---|---|---|---|
| 260,065 | 6/1882 | Tournoux et al. . | |
| 447,991 | 3/1891 | Westwood et al. | 430/291 |
| 494,526 | 3/1893 | Forster . | |
| 581,004 | 4/1897 | Fritsch | 430/198 |
| 679,501 | 7/1901 | Garchey | 430/198 |
| 2,947,626 | 4/1960 | Famely et al. | 430/198 |
| 3,236,647 | 2/1966 | Phlipot | 430/198 |
| 3,674,484 | 7/1972 | Spinski | 430/198 |

FOREIGN PATENT DOCUMENTS

| | | | |
|---|---|---|---|
| 610806 | 12/1960 | Canada | 430/293 |
| 1112239 | 4/1989 | Japan | 430/198 |
| 4093 | 2/1897 | United Kingdom | 430/198 |
| 21081 | 8/1897 | United Kingdom | 430/198 |
| 1006612 | 10/1965 | United Kingdom | 430/198 |

*Primary Examiner*—Janis L. Dote
*Attorney, Agent, or Firm*—Graham & James LLP

[57] ABSTRACT

The present invention is directed to a process for obtaining permanent representations of full-tone, full-color photographs on bases such as ceramics, glass and plastic. This process contemplates the utilization of a set of transparent and opaque ceramic colors or mineral pigments in order to obtain the permanent representations of images on bases.

6 Claims, No Drawings

PROCESS FOR OBTAINING PERMANENT REPRESENTATIONS OF FULL-TONE, FULL-COLOR PHOTOGRAPHS ON A BASE

CROSS REFERENCE

This is a continuation in part of my application Ser. No. 07/844,508, filed Mar. 2, 1992, now abandoned, which is incorporated hereto by reference.

FIELD OF THE INVENTION

The present invention is directed to a process for using a set of transparent and opaque ceramic colors or mineral pigments to obtain a permanent representation of full-tone, full-color photographs on a base.

BACKGROUND OF THE INVENTION

A collodion film, which transfers a ceramic image to a porcelain or glass surface, shrinks in the process of adhering to this surface and drying, and thus the original size of the image is reduced. Similarly, each of the many films produced from the identical amount of liquid collodion (in identical circumstances), while adhering to the surface, shrinks and deforms the ceramic image in different ways. Consequently, it is practically impossible to set together ceramic images made of a set of separation negatives so as to place their contours one over the other, if these images are to be transferred by collodion films.

However, image transferring films made of formulas of the present invention and used in accordance with known methodologies do not change their size in the process of adhering to the surface. Thus, these films do not cause deformation of the transferred image, and they make possible setting together the subsequent constituent images of the final photographic picture with great precision.

It is a significant aspect of this invention that, with the help of the subtractive color process, appropriate sets of transparent and opaque ceramic colors or mineral pigments, applied one over another, are used. This will enable one to obtain full-color photographs, rather than the multicolor photographs obtained by the known processes.

From a photograph or a slide, separation negatives are made, i.e., black-and-white separation negatives of the basic colors of the photograph. This is generally done in the manner outlined below.

A photo reproduction is made from the photograph on black and white, color-sensitive, fine-grain photographic negative film, such as, for example, KODAK T-MAX 100 film. A picture of the photograph is taken four times. Each of these photographs is taken under identical light conditions and at the same distance. The first photograph is taken without a photographic filter, the second with a blue filter, the third with a green filter, and the fourth with a red filter.

A suitable set of additive filters (i.e., blue, green, red) is used, such as, for example, KODAK WRATTEN: No. 47 blue, No. 58 green, No. 25 red. For each of the four photographs, appropriate parameters of exposure are selected. The expose film is processed with standard photochemicals according to technology appropriate to the negative used (i.e., using as a KODAK T-MAX developer).

This processing results in four negatives of the reproduced photograph that differ from each other. Each of these negatives is copied separately to a half-tone, low-contrast, black and white cut graphic film, such as, for example, ORWO FP-1 film. All copies have the same format, which is also the same as the format of the final photograph.

The exposed film is processed with standard photograph chemicals according to the technology appropriate to the film used (developer ORWO A-71, 20° C., 3–5 minutes).

This processing results in a positive set of four black and white separation negatives of the reproduced photograph.

Finally, when all the steps described in this method are carried out, a positive set of the following separation negatives resulting from the reproduction of the original photograph is obtained:

| | |
|---|---|
| a) without a filter | a positive black and white separation negative, which is employed to produce a layer of the image with the use of black ceramic color, |
| b) with the blue filter | a positive black and white separation negative, which is employed to produce a layer of the image with the use of yellow ceramic color, |
| c) with the green filter | a positive black and white separation negative, which is employed to produce a layer of the image with the use of purple ceramic color, |
| d) with the red filter | a positive black and white separation negative, which is employed to produce a layer of the image with the use of blue-green ceramic color. |

Separate contact copies of each of the positive set of four separation negatives are made on four pieces of low contrast, black and white cut graphic film, such as, for example, ORWO FU-2. One separation negative is copied on one piece of cut graphic film. Then exposed pieces of film are processed according to standard techniques suitable for the film used (developer ORWO A-71, 20° C., 3–5 minutes). As a result of this processing, a negative set of four separation negatives of the reproduced photograph is obtained.

The process of the present invention describes a new method for making color photographs. In the present invention, full-tone, full-color images made by using a set of transparent and opaque ceramic colors or mineral pigments can be permanently fixed to bases. Such bases include ceramics (porcelain), glass and plastic. The images made by the process of the present invention have the advantages of invariability of image, color permanence, mechanical resistance, and a lack of susceptibility to physical and chemical conditions such as changes in atmospheric conditions, low and high temperatures, radiation (which ruins conventional photographs), and passage of time, to a degree equal to the resistance of the materials on which they are made.

The process of making photographs in accordance with the present invention can have broad applications in ceramics, glass, artificial materials, construction, architecture, applied and fine arts, documentation, and museum management.

SUMMARY OF THE INVENTION

The present invention is directed to a new process for obtaining permanent representations of full-tone, full-color photographs on bases such as ceramics, glass and plastic. This process contemplates using a set of transparent and opaque ceramic colors or mineral pigments in order to obtain these photographs.

DETAILED DESCRIPTION OF THE INVENTION

The present invention is directed to a process for obtaining permanent representations of full-color, full-tone photographs on ceramics, glass and plastic.

The present invention contemplates a process for using transparent and opaque ceramic colors or mineral pigments to obtain a permanent representation of a full-tone, full-color photograph on ceramic, glass and plastic.

The term "ceramic", as used in the Specification and Claims, refers to a combination of specifically chosen minerals, including clay, which undergoes specialized technical and chemical procedures and is then fired at appropriate temperatures. The resultant product is a "biscuit" which is mechanically brittle and highly water absorbent. To refine the biscuit, a ceramic flux or a ceramic color is applied to its surface and then the biscuit is fired again. After the firing process, the flux (or a fluxing agent in the ceramic color) becomes a hard, water-resistant, glassy shell which strongly adheres to the biscuit.

The term "ceramic flux", as used in the Specification and Claims, refers to a combination of specific minerals which after melting turns into transparent glass which is later ground into powder.

The term "mineral pigments", as used in the Specific and Claims, refers to those pigments combined in specific proportions to oxides of various metals which are melted at high temperatures and are then very finely ground. Their colors vary and they are resistant to high temperatures. At certain given temperatures they acquire predictable colors, and this process can be repeated.

The term "ceramic color", as used in the Specification and Claims, refers to a mineral pigment combined with a ceramic flux. The pigment gives color and the flux fuses it permanently with a ceramic or glass surface in the process of firing at a high temperature. This occurs because the flux contained in the ceramic color which is exposed to a high temperature turn from a solid to a liquid. The glass surface or a fluxing agent contained in the dye of the ceramic also melts slightly. This subtle liquefaction (i.e., turning to a liquid) of both or at least one of the fluxes (e.g. the flux contained in the ceramic color) results in their strongly adhering to each other. Then in the process of cooling down the solids return to their original solid form, i.e., vitrification occurs. Both materials become one. Together with the flux contained in the ceramic color, the pigment melts and adheres to the surface.

The term "collotype", as used in the Specification and Claims, refers to a well known printing technique, which is a photomechanical process for making prints directly from a hardened film of gelatin or other colloid that has ink-receptive and ink-repellant parts.

The term "decalcomania paper", as used in the Specification and Claims, refers to a transfer paper which easily absorbs water. One of the surfaces is covered with water soluble glue.

The term "separation negative", as used in the Specification and Claims, refers to a black and white photograph taken through a special photographic filter. A set of separation negatives of a given photograph taken through a set of special photographic filters constitutes a set of black and white photographs which differ in tone value (i.e., they display varying shades of gray) of the same elements of the photographed picture.

By applying a suitable ceramic color over the image copied from one separation negative, a single color layer of the final photograph is obtained. This process is repeated for the whole set of separation negatives of the original photograph (in such a manner that the outlines of the images of all color layers are placed one over the other). The final color photograph, which is an identical copy of the original photograph, is then obtained.

The photographic image which is transferred to a solid surface contains:

a) high temperature resistant dyes which form the required image after the firing process and fluxing agents contained within resulting in permanent binding with the surface;
b) a film transferring the image, consisting of organic substances which burn away and evaporate during the firing process;
c) organic compounds of a light-sensitive emulsion, which, in the process of firing burn away and evaporate, or partially remain in the form of ashes in an amount not affecting the quality of the image (ammonium bichromate, a component of the emulsion, is washed away in water).

In the method of the present invention, an image is copied from a negative or positive set of separation negatives of the original photograph. Different light-sensitive emulsions are contemplated in the method of the present invention, as demonstrated in Examples I(a) and II(a).

A set of four different transparent and opaque ceramic colors or mineral pigments (each a different color tint) is used to produce a single photographic image. The image is copied from a negative or positive set of separation negatives of the original photograph. The single complete final image is composed of four layers of different transparent and opaque ceramic colors or mineral pigments. The layers are set together with the contours of the images placed one over the other. Exposing four layers of emulsion and dusting them or imprinting them with four constituent images using a set of four different ceramic colors or mineral pigments results in forming a final image. The final ceramic image is transferred from the temporary backing contemplated herein (such as a glass plate, paper decalcomania, or wax paper) to a ceramic, glass or artificial surface and subjected to condition sufficient to fix the photograph to the base.

One embodiment of the present invention relates to a method for producing a ceramic decalcomania which employs the collotype technique. A bichromate light-sensitive emulsion with gelatin is made. This emulsion is poured evenly on temporary backing such as, for example, glass plates. Contact copies of the previously prepared separation negative of the photograph are made on the color-sensitive plate and exposed. A negative set of separation negatives is used. Each of the four separation negatives is copied on a separate photosensitive plate. Thus four matrices are made of the set of separation negatives of the original photograph. The surface of each matrix is then covered, by application with leather and gelatin rollers, with each of four different ceramic colors or mineral pigments. Four constituent images of the final picture are printed from the matrices.

The surface of the final picture is covered with a special formula which forms a film after the solvent is evaporated. This film transfers the final image to ceramic, plastic or glass; it also constitutes a layer separating the image from the ceramic, glass or plastic surface.

Four different variations of the above embodiment are contemplated, as follows.

In the first variation, contemplated for ceramics or glass, a single color full-tone picture is printed on decal paper. This process, of printing on the same decal paper, is repeated three more times. A different matrix, wherein a ceramic color has been applied matching the color on the matrix, is used each time. The color in each case is transparent or opaque, where out of the set of four colors, at least one transparent and at least one opaque color is preferably used. After the fourth color dries, the picture is covered with a drying silk screen printing oil preparation. A full-color picture is obtained. The picture and decal paper are placed on ceramics or glass such that the paper of the decal is on the outside. The decal paper is removed and the picture and the base are heated under conditions sufficient to permanently fix the picture to the base.

In the second variation, contemplated for ceramics or glass, four single color full-tone pictures are printed on four separate decal papers. Ceramic colors or mineral pigments which are transparent or opaque have been applied. At least one of these colors or pigments is transparent and at least one is opaque. Each of the four pictures on decal paper is treated with the drying silk screen printing oil preparation. After the preparation dries, the four wet color pictures are placed, one after the other, on the base with the outlines coinciding. The wet pictures on the bases are dried and the pictures and the base are heated under conditions sufficient to permanently fix the picture to the base.

In the third variation, contemplated for ceramics or glass, a single color full-tone picture is printed on decal paper. The picture and decal paper are placed on ceramics or glass such that the paper of the decal is on the outside. The decal paper is removed and the picture and base are heated under conditions sufficient to permanently fix the picture to the base. This process is repeated three more times with each of the other different transparent or opaque ceramic colors used. Thus the picture on the base is fixed four times, adding the next color picture each time.

In the fourth variation, contemplated for artificial material, such as plastic, all the color layers are printed on the same decal paper. These layers are dried and the resulting image is covered with a fluid-film forming preparation. The decal paper with the picture is then placed on wax paper. The decal paper is removed, and the dry film with the photograph is placed within the artificial material. The picture is then subjected to conditions sufficient to fix the picture to the base.

In another embodiment, a bichromate light-sensitive emulsion with egg white is prepared and used to produce the image. An even layer of drying silk-screen printing oil preparation is poured onto clean smooth glass plates and dried. Then a measured amount of the prepared light-sensitive emulsion described above is poured onto the middle of the glass plates having the dried preparation. Contact copies are made of the previously prepared positive set of separation negatives of the original photograph. The plates are exposed and illuminated with orange artificial light. The picture is then developed by dusting with powdered ceramic color or powdered mineral pigment using the color intended for the copied separate negative. The ceramic color or mineral pigment is transparent or opaque. At least one color or pigment is transparent and at least one is opaque. The color is rubbed into the emulsion with a fine brush. The color adheres to the non-light-struck areas. The plate with the powdered image is dried and the ammonium bichromate is removed from the emulsion. The plate is dried and a full-tone single-color image on a film, placed on the glass plate is obtained. Four different variations which utilize this particular emulsion are contemplated.

In the first variation of the above embodiment, a full-color photograph is obtained by carrying out the process described above and repeating this procedure three times, with three other transparent or opaque colors. This yields four separate full-tone single-color images. Each of these images is placed in turn on each other with the outlines matched, and placed in color sequence.

The entire picture is removed from the glass plate (which, at this phase of the process has been used only as a "temporary" base) and, while wet, is placed on a permanent base such as ceramic or glass. The picture and base are then heated under conditions sufficient to permanently fix the picture to the base.

In the second variation of the above embodiment, contemplated for ceramics or glass, four single color pictures are prepared as described above on four separate plates from separation negatives of one photograph. The film with the first color image is placed on a permanent base and dried. Then the film with the second color is placed on top of the first with the outlines matched. This process is repeated for the film with the third color and the film with the fourth color. After the pictures are dried, the photograph and the base are heated under conditions sufficient to fix the photograph permanently to the base.

In the third variation, contemplated for ceramics or glass, four separate different single color full-tone pictures are produced. The first color picture is placed on the base and heated under conditions sufficient to fix the photograph permanently to the base. This process is repeated three more times with each of the other different transparent or opaque colors used. A full-color full-tone photograph permanently fixed to a base is then obtained.

In the fourth variation, contemplated for artificial material, the drying silk-screen printing oil preparation is substituted with a fluid-film forming preparation. In this variation, all of the set of transparent or opaque colors in the color layers are dusted on the same plate. After the film with the photograph is removed from water, it is placed on wax paper. After the film with the image dries, it is removed from the wax paper and placed within the artificial material. The picture is then subjected to conditions sufficient to fix the picture to the base.

The methods of the present invention result in a final image, i.e., photograph, which is full-tone and full-color.

The Examples below are illustrative and are in no way intended to limit the embodiments of the present invention.

EXAMPLE I

1) Preparation of Light-sensitive Emulsion

A light-sensitive emulsion can be prepared as follows. 8 grams of ammonium bichromate are dissolved in 80 $cm^3$ of distilled water and the volume is brought up to 100 $cm^3$ with water.

In another container, 32 grams of medium-hard gelatin are added to 250 $cm^3$ of distilled water. The gelatin absorbs the water in 1 hour, then the solution is heated for 30 minutes in a water bath to a temperature of 60° C. When the gelatin is completely dissolved, the volume is brought up to 300 $cm^3$ and, as the mixture is stirred, 100 $cm^3$ of the previously prepared ammonium bichromate solution is added.

From this moment, the mixture (emulsion) is light-sensitive and the workplace must then be illuminated with orange light. The emulsion is then filtered and is suitable for use after 24 hours.

After this time, onto a leveled and cleaned surface of glass, 8–10 mm thick, heated to approximately 40° C., a measured quantity of the light-sensitive emulsion at a temperature of 42° C. is poured (a surface of 20 $cm^2$ requires 1 $cm^3$ of emulsion).

The film with the evenly poured emulsion is dried; the temperature should rise to 60° C. over a 2 to 3-hour period. Then it is allowed to cool to room temperature.

Four sensitized plates are prepared and ready for use 24 hours after the emulsion is dried. A negative set of separation negatives is used. Each of the four sensitized plates thus prepared is exposed through a previously prepared separation negative. The four separation negatives are obtained in a conventional fashion, such as by copying the desired image as follows:

| | |
|---|---|
| a) without a filter | black and white separation negative, which is employed to produce a layer of the image with the use of black ceramic color, |
| b) with the blue filter | black and white separation negative, which is employed to produce a layer of the image with the use of yellow ceramic color, |
| c) with the green filter | black and white separation negative, which is employed to produce a layer of the image with the use of purple ceramic color, |
| d) with the red filter | black and white separation negative, which is employed to produce a layer of the image with the use of blue-green ceramic color, |

An arc or xenon lamp is used for the exposures. Exposure time is determined experimentally (and is typically approximately several minutes). Each of the four separation negatives of the negative set is copied on a separate plate.

The exposed plates are immersed in running water at a temperature of 15° C. for 3 hours, then dried at room temperature. The four matrices thus prepared in this way are placed into a container filled with wetting fluid that contains 660 $cm^3$ of glycerine, 340 $cm^3$ of water and 2.5 grams of sodium thiosulfate. After 30 minutes, the matrices are removed and dried. Fine sponges and blotting papers are used for this purpose. By copying the separation negatives on separate sensitized plates in the order described previously matrices are obtained printing for the colors: black, yellow, purple, and blue-green.

Each of these matrices is covered with the matching color. Ceramic colors are used, such as, for example, decorating ceramic colors supplied by the German corporation DEGUSSA. These are opaque ceramic colors (black, blue-green) such as Black No. 14125, Blue-Green No. 11688, and transparent ceramic colors (yellow, purple), such as Yellow No. 73018 or Yellow No. 13529, or Purple No. 77435 or Purple No. 77396 manufactured by DEGUSSA. In addition, there can also be used blue-green transparent ceramic color such as Blue-Green No. ME-25, sold by the Laguna Clay Company in California. Each is a fine powder. Before each color is used, it is thoroughly mixed with turpentine to a consistency of thick lacquer. Leather and gelatin rollers are used for applying the colors to each matrix.

This mixture is rolled out, first with a leather roller then a gelatin roller, in order to cover the rollers with color evenly. Then the evenly coated leather roller is rolled slowly over the printing. Next, one gelatin roller is rolled over the same matrix.

Color is then deposited from the roller onto its respective matrix, such that an image is formed on each of matrix. The leather and gelatin rollers each have a different elasticity and are capable of delivering different amounts of color in different spots on the printing matrix. The use of a set of these two rollers allows for covering with color those spots on the printing matrix which will later print the color picture on, for example, decal paper by means of a lithographic press. A separate set of two such rollers is necessary for each of the four matrices.

2) The Process of Making the Permanent Full-Color, Full-Tone Image a) Process 1

A single-color full-tone picture created by color deposited on one matrix is printed in a lithographic press on decal paper. After the turpentine (which had been mixed with the ceramic color as above) is evaporated from the printed picture, the decal paper will be printed again with the next matrix, to obtain the next full-tone, single-color picture with a different color, in such a way that the outlines of both pictures match, i.e., are in registry.

The printing on the same piece of decal paper is carried out four times using each matrix. A different matrix covered with color matching its color is used each time. Pictures are then printed (using the set of colors or pigments) in the order: blue-green, yellow, purple, black, wherein one can utilize, for example, Blue-Green No. 11688, Yellow No. 73018, Purple No. 77435 and Black No. 14125 from DEGUSSA.

After the fourth color dries, the whole picture on the decal is covered with a drying silk-screen printing oil (such as preparation No. 80661 obtained from DEGUSSA). After this dries, it becomes a uniform, flexible film that retains all of the constituent color pictures in their entirety. This preparation automatically adheres permanently to surfaces such as ceramics, glass, paper or decal paper. A full-tone full-color picture is obtained composed of ceramic colors and placed on decal paper.

The decal carrying the full-tone full-color picture is placed in water at a temperature of 20–30° C. for 10 minutes. When the decal is still wet, it is placed on a piece of ceramic (including porcelain) or glass in such a way that the paper of the decal is on the outside. The piece of ceramic should be white but the glass may be white or transparent. The decal is smoothed to ensure that its whole surface is in contact with the underlying material. Next, lifting any of the edges of the decal paper will separate it completely from the picture.

After this step, a layer of the preparation bearing a full-tone color picture consisting of ceramic colors remains on the piece of ceramic or glass. This photograph is formed of color layers, and each of these layers contains a different ceramic color or a different mineral pigment.

The ceramic or glass object with the picture is dried at a temperature of 20–30° C. for 24 hours, then fired in an electric muffle kiln. The kiln temperature is increased as follows:

a) from 20° C. to 110° C. in 2 hours,
b) from 110° C. to 400° C. in 4 hours,
c) from 400° C. to 560° C. in 1 hour,
d) a temperature of 560° C. is then maintained for 30 minutes, and finally,
e) allowed to cool to a temperature of approximately 30° C.

After cooling, the ceramic or glass piece on which the permanent, full-tone color photograph consisting of ceramic colors has been placed is removed from the kiln.

The same kind of photograph can be obtained by other methods described below.

b) Process 2

In this process a transparent ceramic color such as Blue-Green No. ME-25 is used rather than Blue-Green No. 11688 in Process 1. The picture of each of the four matrices is printed separately on four sheets of decal paper and covered with a fluid film forming preparation which is a drying silk-screen printing oil (such as silk-screen Printing Oil No. 80661 from DEGUSSA) having a function similar to that of collodion. The use of this preparation results in the formation of a transparent film which transfers a photograph made of ceramic colors or mineral pigments to a decorated ceramic or glass surface. After the preparation dries and after the water bath, the four wet color pictures are placed one after the other on the material with the outlines coinciding. These are dried and fired as in process 1, except that in step (a) of the firing process the time is increased to 4 hours and in step (b) of the firing process the time is increased to 6 hours.

c) Process 3

Having four separate images of the colors, as in Process 2, the picture on the piece is fired four separate times, rather than once (as in Process 2). This is carried out as follows. Each color image is placed on the base in the order previously described. After the first color image is placed on the base the color image and base are fired. The firing is done in the manner described in Process 1. This process is repeated three more times.

d) Process 4

A modification of Process 1 makes it possible to make permanent, full-tone color photographs on some artificial materials (laminate, linoleum, vinyl plates).

The matrices are coated with a set of ceramic colors or mineral pigments of black, blue-green, yellow, and purple, such as Black No. 14125, Blue-Green No. 11688, Yellow No. 13529 and Purple No. 77396 from DEGUSSA. After printing all the color layers on the same decal paper and drying them, the resulting image is covered with a fluid film-forming preparation (such as preparation No. 83450 obtained from DEGUSSA) which differs from that used in Process 1–3 above, in that the water lubricated foil does not adhere to a waxed paper surface. When it is dried, a flexible film is formed which resembles a regular photographic film foil. This is placed in its entirety into water at 20–30° C. After 10 minutes, it is removed and placed on stiff waxed paper in such a manner that the paper base of the decal is on the outside. The decal paper base is removed from the picture.

The film that results from the preparation remains on the waxed paper and retains the printed colors or pigments of the image.

In the process of evaporating water from the wet film carrying a photograph that film does not adhere permanently to the waxed paper surface. It merely rests flat on the paper after the water has been evaporated.

The wax paper has been used to:

1) take the wet decal paper off the photograph
2) allow for drying, by means of evaporation of water from any decal paper glue residue which could remain on the photograph after the decal paper is taken off. Dry glue residue does not affect the photograph negatively.
3) allow for evaporating any remaining droplets of water from the film which binds all color layers of the photograph.

The dry film, with the photograph not adhering to the wax paper but resting on it flat, can be picked up by its margins and transferred to the surface being decorated.

The dry color image together with film is placed on the artificial material being manufactured at the appropriate stage of its production. For example, in producing an artificial material for the bases such as a flexible plastic, a first bottom layer is formed. Over that first layer a second layer of a special foil is applied. This foil is a thin sheet of thermoplastic material which melts at a lower temperature than the artificial (i.e., plastic) material it is placed on. The foil, when exposed to sufficiently high temperature conditions becomes sticky and turns white. Over the second layer a third layer is applied. The third layer is a foil with a color decoration (i.e., a color image) which is, in this case, yellow. (After heating, the yellow color disappears). The film (foil) becomes transparent and reveals the white surface formed in the second layer. The photograph then acquires a white background. The image should be placed within the material on a white surface and covered with a fourth layer, which is also foil. The fourth layer when heated at sufficient temperatures becomes sticky and transparent. Heating all the layers of the material at a high temperature, ranging from about 150° C. to 200° C., makes the carrier layer (the third layer) of the image (film), completely transparent and reveals the colors of the photograph. This photograph is formed of color layers, and each of these layers contains a different ceramic color or a different mineral pigment.

Permanent full-tone, full-color images on bases may also be obtained as demonstrated in Example II.

EXAMPLE II

1) Preparation of Light-sensitive Emulsion

A light-sensitive emulsion can be prepared as follows:

The whites of two eggs are beaten to a foam and then placed in a refrigerator to make the foam return again to a fluid state. 10 grams of ammonium bichromate are dissolved in 80 $cm^3$ of distilled water. The volume is brought up to 100 $cm^3$. Three grams of sugar are dissolved in 50 $cm^3$ of distilled water and 5 drops of glycerin are added. To this mixture is added 3 $cm^3$ of fluid from the egg white foam. After this is mixed, 15 $cm^3$ of the solution of ammonium bichromate is added. The volume of the resulting mixture (light-sensitive emulsion) is brought to 100 $cm^3$ with water. After thorough mixing, the fluid is filtered through filter paper of medium permeability.

The emulsion is ready to use after 12 hours. It must be used in a work place illuminated by orange artificial light.

An aqueous solution of polyvinyl alcohol is prepared at the same time. For this, 1 gram of polyvinyl alcohol is added to 500 $cm^3$ of distilled water. After 1 hour, the solution is heated in a water bath in 95° C., completely dissolving the alcohol.

2) The Process of Making the Permanent Full-Color, Full-Tone Image a) Process 1

An even layer of the drying silk-screen printing oil preparation (such as silk-screen Printing Oil No. 80661 from DEGUSSA), thinned with toluene in a 1:3 ratio, is poured onto a cleaned, smooth glass plate 2–4 mm thick. Three $cm^3$ of the fluid is used for each 100 $cm^2$ of glass surface.

Several $cm^3$ of the prepared light-sensitive emulsion are poured onto the middle of the glass plate covered with the dried preparation. After it is distributed evenly over the whole surface, the surplus is poured off. The emulsion is dried on a centrifuge at the rate of 20 rpm at a surrounding temperature of 35° C. for 15 minutes.

The previously prepared positive set of separation negatives of the original photographs is used. On the dried, light-sensitive plate, contact copies are made of the positive separation negative of the color photograph. Arc or xenon lamps are used for light. Exposure time is selected experimentally (approximately several seconds to several minutes).

The exposed plate with the visible outline of the image is transferred to a location with a constant temperature of 22° C. and humidity of 65%, illuminated with orange artificial light. After 30 minutes, the picture is developed by dusting with powdered ceramic color or powdered mineral pigment, using the color intended for the copied positive separation negative. This is done by rubbing the color into the emulsion with a fine brush. The emulsion accepts the color in different amounts in different places, equal to the degree of its hardening as a result of exposure (some places in the emulsion differ in degree of viscosity, proportional to the degree of hardening of the emulsion).

The plate with the powdered image is dried at 40° C. for 1 hour.

After drying, the ammonium bichromate is removed from the emulsion by rinsing in the following manner:

a) the plate is immersed for 30 seconds in water at 10–12° C., then dried in a vertical position at 20–25° C.,
b) the plate is immersed for 2 minutes in water at 10–12° C., then dried vertically at 20–25° C.,
c) the plate is immersed in running water for 5 minutes at 12° C then dried vertically at 20–25° C.,
d) the plate is immersed in running water for 30 minutes, then dried vertically at 20–25° C.

After rinsing, the color picture is dried at 25° C. for 1 hour.

Several $cm^3$ of the aqueous solution of polyvinyl alcohol are poured on the dried plate with the color picture. After the surplus fluid is poured off, the plate is dried in a level position at 40° C.

The result of these operations is a full-tone single-color image on a film placed on the glass plate, providing a special layer separating the so formed color image or picture from a subsequent layer of light sensitive emulsion.

To obtain a full-tone, full-color photograph the procedure specified herein is carried out a total of four times. All color images appear on a single glass plate by being placed in turn on each other with the outlines matched. For each of the four copies a different positive separation negative is used, and the exposed image of the positive separation negative is dusted with a different ceramic color or mineral pigment of matching color. The set of colors are placed in the following sequence: blue-green, yellow, purple and black, utilizing, for example, transparent Blue-Green No. ME-25, transparent Yellow No. 13529, transparent Purple No. 77396 and opaque Black No. 14125. This results in four sets of colors or pigments containing three different transparent ceramic colors or three different transparent mineral pigments (blue-green, yellow and purple), together with a black opaque ceramic color or mineral pigment. Alternatively, the four sets of colors or pigments may consist essentially of two different transparent colors or pigments selected from blue-green, yellow and purple, with an opaque color or pigment which is not one of the colors blue-green, yellow and purple and a black opaque ceramic color or mineral pigment.

After preliminary scoring of the film on the glass, the whole picture with the glass is immersed in water at 20° C. After 10 minutes, an edge of the scored film is lifted with a single movement and the whole picture is removed from the water, (the glass remains in the water).

While wet, it is placed on ceramic or glass.

After drying, it is fired according to the following technology:

a) from 20° C. to 110° C. in 4 hours,
b) from 110° C. to 440° C. in 6 hours,
c) allowed to cool to 20° C.

The cooled, partially fired picture is immersed in running water at 20° C. After 10 minutes, the picture is removed and dried, then fired as follows:

a) from 20° C. to 110° C. in 1 hour,
b) from 110° C. to 560° C. in 2 hours,
c) 560° C. is maintained for 30 minutes,
d) allowed to cool to 30° C.

This results in a permanent, full-tone, full-color photograph on a base in the form of ceramic (including porcelain) or glass. This photograph is formed of color layers, and each of these layers contains a different ceramic color or a different mineral pigment.

b) Process 2

In this process, an opaque blue-green ceramic color such as Blue-Green No. 11688 is used rather than transparent Blue-Green No. ME-25 as in Process 1.

A set of four color pictures is prepared on separate plates from a positive set of separation negatives of one photograph. The film with the blue-green image is placed on a permanent base. After this is dried, the yellow image is placed on it with the outlines matched. In turn, in the same manner, the purple and then the black images are placed on it. After drying, the photograph is fired in the manner described in Process 1 above.

c) Process 3

Having four separate images of the colors, as in Process 2, the picture on the piece is fired four separate times, rather than once (as in Process 2). This is carried out as follows. Each color image is placed on the base in the order previously described. After the first color image is placed on the base the color image and base are fired. The firing is done in the manner described in Process 1. This process is repeated three more times.

d) Process 4

Replacing the silk-screen printing oil preparation (such as Printing Oil No. 80661 from DEGUSSA) with the fluid-film forming preparation (such as Fluid Film No. 83450 from DEGUSSA), dissolved in toluene, 1:9, and using the ceramic colors or replacing them with mineral pigments (utilizing for example, a set of Blue-Green No. ME-25 from Lagunay Clay Company and Yellow No. 13529, Purple No. 77396 and Black No. 14125 from DEGUSSA) and utilizing the technology of Process 1, a photograph is produced which is suitable for application to artificial materials. After the film with the photograph is removed from water, it is placed on waxed paper and then the procedure in Example I, Process 4 is followed.

The discovery resulting from making photographs according to the methods described in Example I confirms that a set of transparent and opaque ceramic colors or mineral pigments have properties that can be exploited for making decals for transfer of permanent, full-tone, full-color photographs to bases intended for firing, such as ceramics (including porcelain) and glass, and for embedding in plastic.

The discovery resulting from making photographs according to the methods described in Example II:

a) confirms that a set of transparent and opaque ceramic colors or mineral pigments can be used for making permanent, full-tone color photographs on bases such as ceramics (including porcelain), glass or plastic;
b) reveals using a dry preparation in the form of film as a carrier for poured light-sensitive emulsion, preparing an image, and placing images one over another by the dusting method of the present invention;
c) demonstrates an advantageous difference in exploiting film. This difference consists of the fact that the preparations making the films lift images formed on other surfaces and transfers them to bases for firing. Previously, some of the colors forming the image remained on the surface from which the image was to be transferred. Thus the colors were not fully transferred and the image was damaged. However, in the solution developed here, the image is created on film made from the preparation after emulsion is poured on it. Thus, the transferred image of the present invention does not result in a damaged image; and d) creates a technology that makes it possible to make permanent full-tone color photographs on bases such as ceramics (including porcelain), glass, or plastics by pouring light-sensitive emulsion onto a carrier made of a special dried preparation.

What is claimed is:

1. A process for producing permanent full-color, full tone images on a base comprising the successive steps of:

(a) applying a drying silk-screen printing oil preparation to a temporary backing, drying, then applying a light-sensitive ammonium bichromate emulsion, containing egg white, to the oil preparation on the temporary backing;

(b) then exposing the backing to light, with a separation negative of an original photograph thereon;

(c) dusting said exposed backing with a ceramic color or mineral pigment selected from a set of transparent and opaque ceramic colors or a set of transparent and opaque mineral pigments;

(d) drying said backing;

(e) removing ammonium bichromate from the ammonium bichromate emulsion on the backing, by rinsing;

(f) obtaining and drying a color picture on said backing;

(g) applying a polyvinyl alcohol solution to the backing, with the color picture thereon, to form a special layer separating the color picture from a subsequent layer of light-sensitive emulsion;

(h) drying the backing and the color picture;

(i) repeating the above process three more times, beginning with the application of the light-sensitive emulsion in step (a) and continuing through to step (h), with a different color on the same backing each of three times, wherein color pictures, successively obtained, are placed one on top of the other in registry;

(j) transferring a resulting full-color, full-tone picture obtained from four different colors, during the initial process of steps (a) through (h) and the repetition thereof, three subsequent times; from the backing to the base;

(k) fixing the picture to the base;

(l) obtaining a full-color, full tone image on a base.

2. The process of claim 1 wherein said base is ceramic, glass or plastic.

3. The process of claim 2 wherein said base is ceramic or glass and said fixing comprises heating from 20° C. to 110° C. over a period of 4 hours, heating from 110° C. to 440° over a period of 6 hours and cooling to 20° C., and after maintaining the temperature of 20° for 10 minutes increasing the temperature from 20° C. to 110° C. over a period of 1 hour, then increasing the temperature from 110° C. to 560° C. over a period of 2 hours, maintaining the temperature at 560° C. for 30 minutes and cooling to 30° C.

4. The process of claim 1 wherein said temporary backing is a glass plate.

5. The process of claim 1 wherein in step (c), the said ceramic color or mineral pigment from four sets of four different colors or pigments, during the initial process and the three repetitions thereof, contains three different transparent ceramic colors or three different transparent mineral pigments which are blue-green, yellow and purple and further contains one black opaque ceramic color or black opaque mineral pigment.

6. The process of claim 1 wherein in step (c), said ceramic color or mineral pigment is one of the set of four different colors or pigments which contains two different transparent ceramic colors or two different transparent mineral pigments of two of the colors consisting essentially of blue-green, yellow and purple, further wherein said set contains one opaque ceramic color or one opaque mineral pigment which is not used from among blue-green, yellow and purple and another opaque ceramic color or opaque mineral pigment which is black.

* * * * *